US007246590B2

(12) United States Patent
Karbstein et al.

(10) Patent No.: US 7,246,590 B2
(45) Date of Patent: Jul. 24, 2007

(54) VALVE TRAIN OF AN INTERNAL COMBUSTION ENGINE COMPRISING A TAPPET AND A TAPPET PUSHROD

(75) Inventors: Henning Karbstein, Adelsdorf (DE); William Carter, Macomb, MI (US); David Kehr, Dearborn, MI (US)

(73) Assignee: Schaeffler KG, Herzogenaurach (DE)

( * ) Notice: Subject to any disclaimer, the term of this patent is extended or adjusted under 35 U.S.C. 154(b) by 56 days.

(21) Appl. No.: 11/304,461

(22) Filed: Dec. 15, 2005

(65) Prior Publication Data

US 2006/0169236 A1 Aug. 3, 2006

Related U.S. Application Data

(60) Provisional application No. 60/637,274, filed on Dec. 17, 2004.

(51) Int. Cl.
*F01L 1/14* (2006.01)

(52) U.S. Cl. ..... 123/90.61; 123/90.35; 123/90.48; 123/90.55; 74/569; 74/587

(58) Field of Classification Search ..... 123/90.61
See application file for complete search history.

(56) References Cited

U.S. PATENT DOCUMENTS 3,144,010 A 8/1964 Van Slooten
4,602,597 A 7/1986 Rhoads
7,077,090 B2 * 7/2006 Sailer et al. ..... 123/90.52
7,174,870 B2 * 2/2007 Rutsey ..... 123/90.61

FOREIGN PATENT DOCUMENTS

DE 19 83 334 U 4/1968
DE 19 92 038 U 8/1968
DE 33 43 324 A1 6/1984
DE 10 2004 019 282 A1 12/2005

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a valve train (1) of an internal combustion engine comprising a tappet (7) and a tappet pushrod (1) that is actuated by said tappet (7), said tappet pushrod (1) being at least partly hollow and comprising on one end (3), a first support (4) for a pressure piston (5) of a hydraulic lash adjuster (6) of said tappet (7) that follows a periodic driving element such as a cam. A second support (9) for a follower member (2) such as a rocker arm is arranged on a further end (8) of the tappet pushrod (1). The first support (4) comprises a passage (10) for hydraulic medium that can be routed out of the pressure piston (5) during operation of the internal combustion engine into an interior (11) of the tappet pushrod (1), a one-way valve means (12) being installed in the tappet pushrod (1) for retaining a hydraulic medium column during a standstill of the internal combustion engine. In this way, an additional reservoir for hydraulic medium is created that serves for the rapid filling of the pressure piston (5) immediately after a re-starting of the internal combustion engine.

8 Claims, 2 Drawing Sheets

VALVE TRAIN OF AN INTERNAL COMBUSTION ENGINE COMPRISING A TAPPET AND A TAPPET PUSHROD

The application claims the benefit of provisional patent application Ser. No. 60/637,274 filed Dec. 17, 2004.

FIELD OF THE INVENTION

The invention concerns a valve train of an internal combustion engine comprising a tappet and a tappet pushrod that is actuated by said tappet, said tappet pushrod being at least partly hollow and comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod.

BACKGROUND OF THE INVENTION

A valve train of the pre-cited type is disclosed in U.S. Pat. No. 6,196,175 B1. The tappet of this valve train is configured as a switchable roller tappet and is installed in a relatively strongly restricted mounting space, so that only an inadequate quantity of hydraulic medium can be contained in its pressure piston. However, in various situations such as upon re-firing of the internal combustion engine after a longer standstill, "taxi operation" etc., this hydraulic medium proves to be insufficient for a proper lash adjusting operation of the lash adjuster. Therefore, a relatively high risk of a re-aspiration of air into the high pressure chamber of the lash adjuster exists with all the drawbacks, like rattling noises, wear etc., known in the technical field.

Moreover, it is usual in OHV trains comprising a roller tappet and a tappet pushrod to lubricate further components like rocker arms, cam-contacting surfaces etc. that are situated at a high geodetic level, through a hollow tappet pushrod. This is also disclosed in the pre-cited U.S. Pat. No. 6,196,175, while U.S. Pat. No. 3,908,615 likewise discloses a hollow tappet pushrod. Further, U.S. Pat. No. 5,351,662 shows a tappet configured as a roller tappet in which it can be seen that, for design reasons, the hydraulic lash adjuster can contain only a very small quantity of hydraulic medium.

OBJECTS OF THE INVENTION

It is an object of the invention to provide a valve train of the pre-cited type in which the aforesaid drawbacks are eliminated.

This and other objects and advantages of the invention will become obvious from the following detailed description.

SUMMARY OF THE INVENTION

The invention achieves the above objects by the fact that a one-way valve means is installed in the tappet pushrod for retaining, during a standstill of the internal combustion engine, a hydraulic medium column which, as viewed in gravity direction, is situated above the one-way valve means.

In this way, an additional volume of hydraulic medium is created. For this purpose, the invention has recourse to normally already used hollow tappet pushrods, and through the one-way valve means proposed by the invention, a larger part of the hydraulic medium transported through the tappet pushrod during operation is retained, so that, upon starting of the internal combustion engine, this quantity of hydraulic medium is available as an "additional oil supply" for the reservoir of the hydraulic lash adjuster.

The one-way valve bodies may be configured, for example, as balls, cones, plates or the like. These are held in a suspended state in the interior of the tappet pushrod during the passage of the hydraulic medium through the tappet pushrod during operation of the internal combustion engine. When the internal combustion engine is turned off and the pressure medium pressure thus decreases, the one-way valve means drops back into its seat due to the force of gravity and prevents a further re-flow of the hydraulic medium column situated above it.

Advantageously, the one-way valve means is configured together with an inner wall of the tappet pushrod as a choke for the hydraulic medium, so that, during the operation of the internal combustion engine, no unnecessarily high losses of hydraulic medium in the direction of the second support have to be feared. It is understood that the passages themselves may likewise comprise choking features.

The release of the hydraulic medium stored above the one-way valve means is caused by the vibrations occurring immediately after the internal combustion engine is started, for example, due to the reciprocating motion of the tappet pushrod.

The proposed floating body (ball, tapered cylinder etc.) that forms a part of the one-way valve means may be made of metal but likewise of a light-weight material like plastic, as a solid or a hollow construction. If the floating body is a ball, it extends with play relative to an inner wall of the tappet pushrod, so that, on the one hand, it cannot get clamped and, on the other hand, the desired choking effect can be achieved.

If a tapered body is used, that according to a further proposition of the invention may also be tapered at both ends, this body advantageously comprises longitudinal grooves on its outer peripheral surface for permitting a through-flow of the hydraulic medium.

According to still another proposition of the invention, the tappet pushrod is configured with quasi identical components (supports, passages, valve seats) on both sides of its central transverse plane. The floating body in this case can be a ball or a cylinder tapered at both ends. In this embodiment, the tappet pushrod can also be installed laterally reversed in the valve train which is advantageous for mounting purposes.

It is understood and proposed by the invention that the separate cylindrical part may also be arranged only in the region of the first support.

The proposed separately manufactured tappet pushrod has the advantage that it can be easily mounted in different kinds of internal combustion engines without complex modifications to any other parts.

Finally, the invention also proposes to configure the supports of the tappet pushrod in the form of ball heads. It is clear that other joint configurations, like, for example, pot or cylindrically arched shapes etc. can also be used for this purpose.

Although the scope of the invention is related particularly to OHV trains, this is not exclusive.

The invention will now be described more closely with reference to the appended drawing.

DETAILED DESCRIPTION OF THE DRAWING

Figure 1:
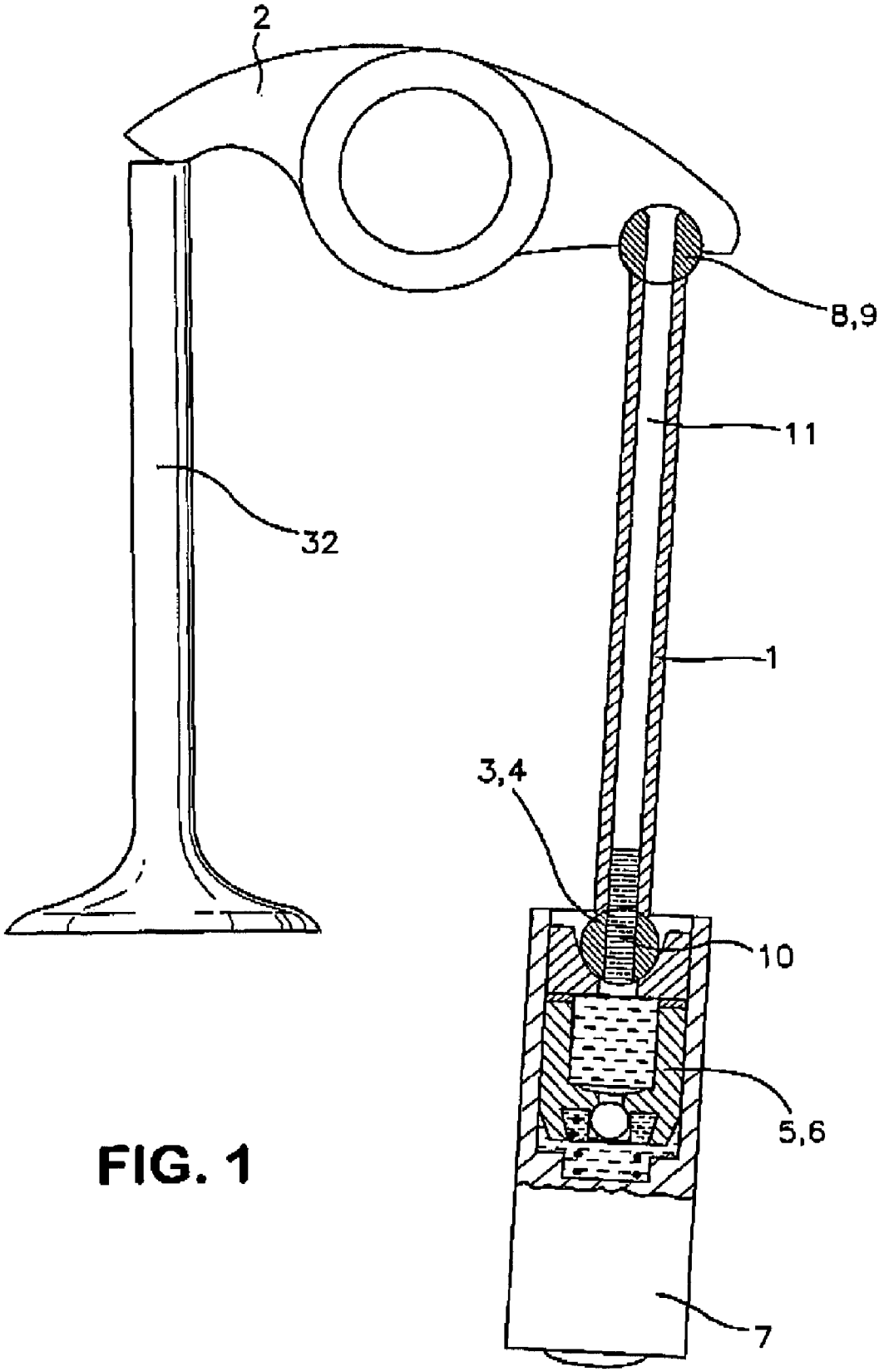
FIG. 1 is a schematic view of a valve train.

FIG. 1 illustrates a valve train of an internal combustion engine, comprising a tappet 7 configured as a roller tappet. The tappet 7 comprises an axially displaceable pressure piston 5 that forms a part of a hydraulic lash adjuster 6. At its lower end, the tappet 7 follows a cam, not illustrated, and acts at its other end on a first support 4 of one end of a tappet pushrod 1.

In the present case, the tappet pushrod 1 has a tubular configuration, and hydraulic medium from the pressure piston 5 can be routed through its interior 11 toward a follower member 2, configured here as a rocker arm. The follower member 2, in its turn, acts in lift direction on a gas exchange valve 32.

It can be further seen in FIG. 1 that, in the region of its other end 8, the tappet pushrod 1 possesses a second support 9 for the follower member 2. Similar to a passage 10 of the first support 4, this second support 9 also comprises a passage 13 for the hydraulic medium.

As described above, the quantity of hydraulic medium that can be contained or is contained in the pressure piston 5 is too small for some special cases of use. This is where the invention becomes effective. It is proposed, namely, to install a one-way valve means 12 in the tappet pushrod 1 to retain a hydraulic medium column, shown schematically in FIG. 1, during a standstill of the internal combustion engine. Through this one-way valve means 12, it is achieved that the hydraulic medium situated above this one-way valve means 12 when the engine is shut off, is retained in the tappet pushrod 1 and is released to flow toward the pressure piston 5 when the engine is started, particularly due to the then occurring vibrations, so that a proper lash adjustment can be executed by the lash adjuster 6.

Figure 2:
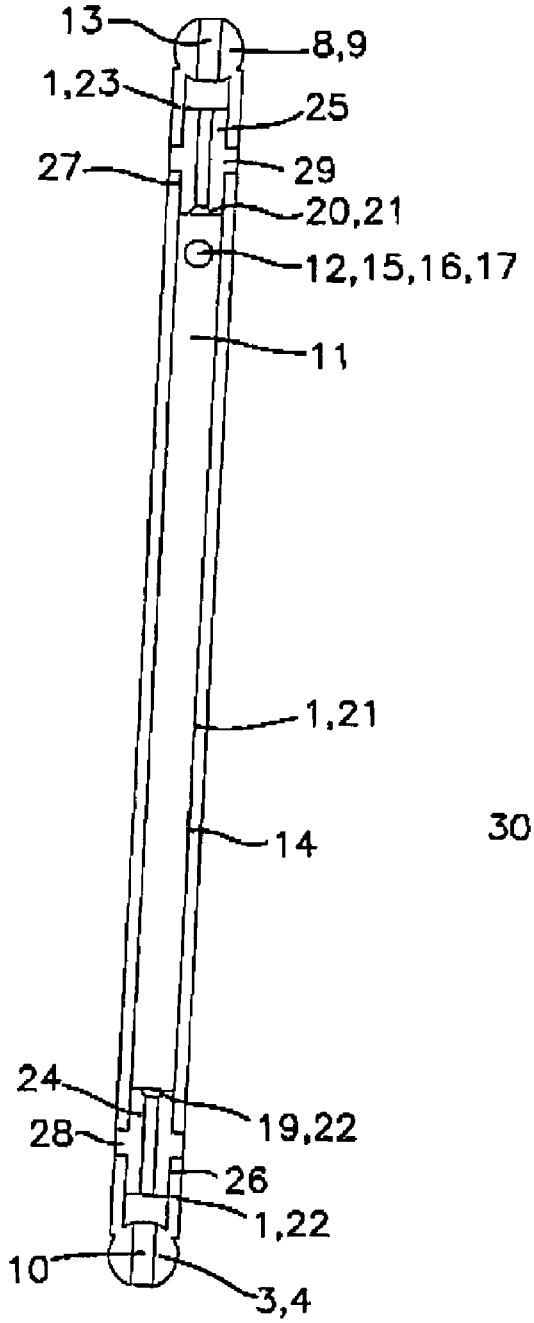
FIG. 2 shows an advantageous embodiment of the tappet pushrod of FIG. 1.

As disclosed in FIG. 2, a floating body 16 configured as a ball 17 is arranged in the interior 11 of the tappet pushrod 1. Further, a valve seat 19 for the ball 17 that forms a further element of the one-way valve means 12 is arranged in the region of the first support 4 and communicates with the passage 10.

The tappet pushrod 1 of FIG. 2 is made completely symmetric on both sides of its central transverse plane. It is, however, also possible to make the tappet pushrod only with the parts that are arranged below the central transverse plane, while above the central transverse plane, the second support 9 on the other end 8 can be configured in the "classical" manner shown in FIG. 1.

According to FIG. 2, the tappet pushrod 1 is made up of a total of three sections 21, 22, 23. Section 21 is constituted by an elongate center part. Section 22 comprises the first support 4 configured in the present case as a ball head. Section 23 comprises the second support 9, likewise configured as a ball head. The sections 21, 22, 23 are connected to one another by cylindrical parts 24, 25 having annular collars 28, 29. To put it more concretely, the aforesaid parts 21, 22, 23 are plugged together through an outer peripheral surface 26, 27 of the respective cylindrical part 24, 25 and abut against the respective annular collar 28, 29. To create permanent connections in these regions, it is possible to use a press fit, a screw connection, a weld joint, a shrink fit or the like.

Looking at the lower part of FIG. 2, one sees that the cylindrical part 24 comprises on the side of the section 21, a valve seat 19 that forms a part of the one-way valve means 12. During the operation of the internal combustion engine, hydraulic medium is conveyed via the passage 10 of the first support 4 through a bore of the cylindrical part 24 into the interior 11 of the tappet pushrod 1. Not taking the further cylindrical part 25 into account, the hydraulic medium is routed through the passage 13 of the second support 9 to the follower member 2.

The ball 17 is designed such that it remains in a suspended state in the interior 11 of the tappet pushrod 1 when hydraulic medium pressure prevails. When the pressure drops after the internal combustion engine is turned off, the ball 17 sinks into its valve seat 19. This prevents the hydraulic medium that is situated thereabove from flowing-through in gravity direction. In this way, an additional hydraulic medium reservoir is created in the tappet pushrod 1. Due to the vibrations that occur upon a re-firing of the internal combustion engine, the ball 17 lifts off its seat 19. The quantity of hydraulic medium thus released flows into the reservoir of the pressure piston 5 and is additionally available for lash adjustment.

Because, as can be seen in FIG. 2, the tappet pushrod 1 is made up of identical parts on both sides of its central transverse plane, it can also be installed laterally reversed. It is further clear that the tapered cylinder shown in FIG. 3, if tapered at both ends, can likewise be used in a symmetric tappet pushrod 1 of FIG. 2, with appropriate valve seats of complementary shape.

Figure 3:
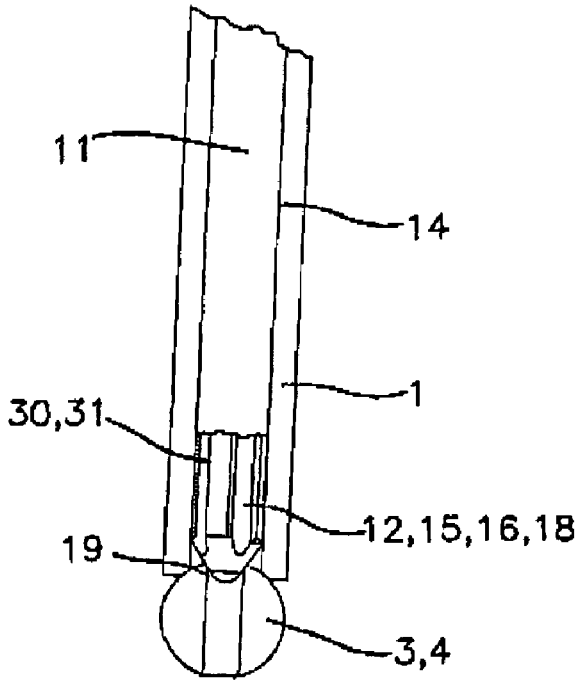
FIG. 3 shows another advantageous embodiment of the tappet pushrod of FIG. 1.

The floating body 16 of FIG. 3, configured as a tapered cylinder, comprises on its outer peripheral surface 30, circumferentially spaced longitudinal grooves 31 for a passage of hydraulic medium to form the choke 15. In this embodiment, too, the cylinder 18 drops into its valve seat 19 when the internal combustion engine is turned off, rises due to the vibrations occurring upon a re-firing of the internal combustion engine and permits the quantity of hydraulic medium previously enclosed above it to flow into the pressure piston 5 of the lash adjuster 6.

The invention claimed is:

1. A valve train of an internal combustion engine comprising a tappet and a tappet pushrod that is actuated by said tappet, said tappet pushrod being at least partly hollow and comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, wherein a one-way valve means is installed in the tappet pushrod for retaining, during a standstill of the internal combustion engine, a hydraulic medium column which, as viewed in gravity direction, is situated above the one-way valve means, the second support comprises a passage for the hydraulic medium to the follower member, and the one-way valve means is configured to form together with an inner wall of the tappet pushrod, a choke for limiting a flow of hydraulic medium to the passage in the second support and a floating body is installed in the interior of the tappet pushrod, said floating body has a geometry of one of a ball, a cylinder tapered toward the first support or a plate and forms a part of the one-way valve means, a valve seat for said floating body extends in a region of the first support and communicates with the passage of the first support.

2. A valve train of claim 1, wherein a floating body is installed in the interior of the tappet pushrod, said floating body has a geometry of one of a ball, a cylinder tapered at two ends or a plate and forms a part of the one-way valve means, at least substantially identical valve seats for said floating body extend in a region of the first and second supports and communicate with the passages of the first and second supports.

3. A valve train of claim 2, wherein the tappet pushrod is at least substantially identically configured with supports, passages and valve seats on both sides of a central transverse plane.

4. A valve train of claim 2, wherein the tappet pushrod is composed of at least three fabricated sections, a first one of said sections forming a center part and a second and a third one of said sections forming end parts comprising the supports, the valve seats are formed on separate cylindrical parts each of which comprises an annular collar projecting from an outer peripheral surface thereof, one end of the first section is plugged onto an end of each outer peripheral surface, and a region of the second and third sections facing away from the respective support is plugged onto another end of each outer peripheral surface, and the three sections abut against front ends of the annular collar of the associated cylindrical part.

5. A valve train of claim 3, wherein the tappet pushrod is composed of at least three fabricated sections, a first one of said sections forming a center part and a second and a third one of said sections forming end parts comprising the supports, the valve seats are formed on separate cylindrical parts each of which comprises an annular collar projecting from an outer peripheral surface thereof, one end of the first section is plugged onto an end of each outer peripheral surface, and a region of the second and third sections facing away from the respective support is plugged onto another end of each outer peripheral surface, and the three sections abut against front ends of the annular collar of the associated cylindrical part.

6. A valve train of claim 1, wherein the tapered cylinder forming a part of the one-way valve comprises longitudinal grooves on an outer peripheral surface.

7. A valve train of claim 2, wherein the tapered cylinder forming a part of the one-way valve comprises longitudinal grooves on an outer peripheral surface.

8. A valve train of claim 1 wherein the supports of the tappet pushrod are configured as ball heads.

* * * * *